US006360520B2

(12) United States Patent
Poquette et al.

(10) Patent No.: US 6,360,520 B2
(45) Date of Patent: Mar. 26, 2002

(54) SPINNING RING HAVING AMORPHOUS CHROMIUM BEARING SURFACE

(75) Inventors: Gereon E. Poquette, Denver; Jason P. Floder; Joe D. Faris, both of Gastonia, all of NC (US)

(73) Assignee: AB Carter, Inc., Gastonia, NC (US)

( * ) Notice: Subject to any disclaimer, the term of this patent is extended or adjusted under 35 U.S.C. 154(b) by 0 days.

(21) Appl. No.: 09/755,440

(22) Filed: Jan. 5, 2001

Related U.S. Application Data

(60) Provisional application No. 60/176,262, filed on Nov. 14, 2000.

(51) Int. Cl.[7] ..... D01H 7/60
(52) U.S. Cl. ..... 57/119
(58) Field of Search ..... 57/137, 126, 136, 57/125, 124, 119

(56) References Cited

U.S. PATENT DOCUMENTS

| | | | |
|---|---|---|---|
| 273,090 | A | 2/1883 | Husband |
| 1,595,858 | A | 8/1926 | Crompton |
| 2,194,930 | A | 3/1940 | Feen |
| 2,683,346 | A | 7/1954 | Pieper |
| 2,798,357 | A | 7/1957 | Stähli |
| 3,118,272 | A | 1/1964 | Clapp |
| 3,343,362 | A | 9/1967 | Lunsford |
| 3,421,307 | A | 1/1969 | Lunsford |
| 3,583,713 | A | 6/1971 | Sugahara |
| 3,806,139 | A | 4/1974 | Suzuki et al. |
| 3,932,228 | A | 1/1976 | Sugiyama et al. |
| 4,079,579 | A | 3/1978 | Cory |
| 4,092,226 | A | 5/1978 | Laing et al. |
| 4,308,715 | A | 1/1982 | Staehli |
| 4,366,034 | A | 12/1982 | Ricks et al. |
| 4,406,756 | A | 9/1983 | Baranyi |
| 4,677,817 | A | 7/1987 | Kanai |
| 4,698,958 | A | 10/1987 | Nakano et al. |
| 4,717,456 | A | 1/1988 | Chessin et al. |
| 4,731,166 | A | 3/1988 | Jones |
| 4,885,905 | A | 12/1989 | Maruta et al. |
| 5,086,615 | A | 2/1992 | Bodnar |
| 5,175,988 | A | 1/1993 | Kibe |
| 5,313,773 | A | 5/1994 | Poquette et al. |
| 5,584,168 | A | 12/1996 | Artzt et al. |
| 5,829,240 | A | 11/1998 | Benson et al. |

FOREIGN PATENT DOCUMENTS

| | | |
|---|---|---|
| GB | 15134 | 8/1989 |
| JP | 55-40843 | 3/1980 |
| JP | 60-2719 | 1/1985 |
| JP | 60-2720 | 1/1985 |
| JP | 63-315617 | 12/1988 |
| JP | 63-315618 | 12/1988 |
| JP | 3839920 | 6/1989 |
| JP | 1-292123 | 11/1989 |
| JP | 3-90635 | 4/1991 |

(List continued on next page.)

OTHER PUBLICATIONS

Hard Chromium Plating, H. Chessin, et al., *Metals Handbook*, Ninth Edition, vol. 5, "Surface Cleaning, Finishing, and Coating," pp. 170–187.

*Corrosion and Wear Properties of Electrodeposited Amorphous Chrome*, Yong Choi, Department of Metallurgical Engineering, Sun Moon University, Asan–City, Chung–Nam 336–840, Korea.

*Primary Examiner*—Danny Worrell
(74) *Attorney, Agent, or Firm*—Alston & Bird LLP

(57) ABSTRACT

The invention provides spinning rings for textile spinning processes having an improved bearing surface formed of a coating of amorphous chromium that is typically applied by an electrodeposition process. The amorphous chromium coated spinning rings of the present invention impart a durable spinning ring that can be used in fine yarn, high speed spinning operations without the need to provide for a conventional break-in period.

14 Claims, 7 Drawing Sheets

FOREIGN PATENT DOCUMENTS

| | | |
|---|---|---|
| JP | 3-174024 | 7/1991 |
| JP | 4-82923 | 3/1992 |
| JP | 5-93320 | 4/1993 |
| JP | 5-106124 | 4/1993 |
| JP | 5-117927 | 5/1993 |
| JP | 5-186917 | 7/1993 |
| JP | 5-195342 | 8/1993 |
| JP | 5-302223 | 11/1993 |
| JP | 5-331721 | 12/1993 |
| JP | 6-158443 | 6/1994 |
| JP | 6-173127 | 6/1994 |
| WO | WO 80/00718 | 4/1980 |

SPINNING RING HAVING AMORPHOUS CHROMIUM BEARING SURFACE

CROSS-REFERENCE TO RELATED APPLICATIONS

The present application claims priority from U.S. Provisional Patent Application Serial No. 60/176,262 Nov. 14, 2000, the contents of which are incorporated by reference.

FIELD OF THE INVENTION

The present invention relates to a spinning ring for textile yarn spinning and more specifically relates to a spinning ring having a low friction, high durability bearing surface for supporting a traveler.

BACKGROUND OF THE INVENTION

In conventional spinning and twisting operations, spinning or twisting rings are used to support a traveler that moves rapidly around the circumference of the spinning ring. The traveler engages and guides a loose yarn as it is being twisted and wound onto a twisting spindle.

An increase in spinning speed increases the rate at which the traveler rotates around the surface of the spinning ring thereby also increasing the centrifugal force applied between the traveler and the ring. In turn, the greater centrifugal force increases frictional heating of the traveler and the spinning ring while also increasing the abrasive force applied to the traveler and to the spinning ring. Accordingly, spinning speed increases can cause burn-off and/or shortening of the lifetime of the traveler, and also typically decrease the lifetime of the spinning ring because the bearing surface of the ring can spall, chip, or otherwise become roughened.

As spinning speeds are increased the resulting increase in frictional or abrasive forces between the traveler and spinning ring can cause breaks in the yarn being spun or twisted. Yam breaks are particularly undesirable because they lead to downtime in the spinning operation and, thus, a lower manufacturing efficiency. In general, for a given spinning ring and traveler combination, there exists a practical spinning speed limit that cannot be exceeded without frequent breakage of yams. For this reason, the choice of traveler and spinning rings (i.e. the construction of the traveler and spinning rings) can have a substantial impact on manufacturing efficiency.

Spinning ring durability also impacts substantially on manufacturing efficiencies and/or costs. In particular, degradation of the bearing surface of the spinning ring by spalling, chipping or the like, is normally a gradual process. As the bearing surface of the spinning ring degrades, the frictional characteristics of the bearing surface increase. Although in some cases the initial degradation of the spinning ring surface can be addressed by decreasing spinning speeds and/or by selecting travelers of different weight or construction, the manufacturing non-uniformities and potential disruptions associated with changes in the frictional characteristics of the ring surface are costly in many cases and undesirable in any event. Accordingly, the bearing surface of the spinning ring should preferably exhibit uniform frictional characteristics over a substantial period of time, even when the spinning operation is conducted at extremely high speeds.

Attempts to simultaneously address spinning ring surface durability characteristics while also achieving sufficiently low frictional characteristics to allow high spinning speeds have met with only limited success until recent times, due, at least in part, to the contradictory objectives associated with high durability surfaces, and those associated with low friction surfaces. Specifically, high durability surfaces that are resistant to abrasive force typically possess an inherent hardness sufficient to apply significant abrasive forces to a traveler. However, if surface hardness of the ring is decreased in order to decrease the abrasive characteristics of the surface, the durability of the ring surface generally also suffers.

In this regard the textile industry has recently developed spinning rings having ceramic coatings and co-deposited metal/abrasion resistant materials on the bearing surface thereof, to impart superior hardness and superior durability. However, in practice, these spinning rings generally require a substantial break-in period. During the break-in period, the spinning equipment is operated at a relatively low spinning speed because the surface of the spinning ring is initially too rough to allow operation at high speed. The low speed spinning operation allows the initially rough surface of the spinning ring to be conditioned by contact with a moving traveler. Such break-in periods can last for time periods of one month or longer, thus substantially decreasing manufacturing efficiencies.

More recently, spinning rings have been provided that are capable of high-speed operations over a period of several years. These rings have a bearing surface comprising an electrodeposited coating of hard, nodular chromium, and are described in U.S. Pat. No. 5,829,240, entitled "Spinning Ring Having Improved Traveler Bearing Surface" issued Nov. 3, 1998, in the name of inventors Rio H. Benson and Gereon E. Poquette and assigned to A. B. Carter, Incorporated, the assignee of the present invention. In most cases, when these rings are treated in a polishing operation prior to use, only a relatively shortly break-in period is required prior to use of these rings in extremely high speed spinning operations. Nevertheless, in the case of fine yarns, break-in times of 1–2 weeks can be required in order to sufficiently condition the surface of the ring for use in high speed operations due to the relatively low weight travelers used in spinning fine yarns. The lighter travelers apply less conditioning force to the surface of the spinning rings and the lighter travelers are also more susceptible to damage with the result that the break-in period is longer and more travelers are used during the break-in period.

Although various conventional spinning rings can minimize or even eliminate break-in time for fine yarn spinning operations, these rings typically suffer from the undesirably low durability properties associated with spinning rings of conventional construction. For example, spinning rings described in U.S. Pat. No. 5,086,615, entitled "Coated Spinning Rings and Travelers", issued in the name of inventor Bodnar, on Feb. 11, 1992, that have a surface coating with a particulate polymeric fluorocarbon dispersed in a metallic matrix, can have a very short break-in time requirement, but also typically have a useful life of less than about one year.

As detailed above, the textile industry desires a spinning ring that can impart increased durability and spinning speed over prolonged use periods without increasing the inefficient break-in period required to operate the device at standard productivity spinning speeds. To date, the successful modifications that have been used in conjunction with the spinning ring to improve durability and useful spinning speed have been hampered by typically requiring costly and sophisticated coating processes, modifications to the travelers used with the spinning rings and/or increased periods of break-in.

SUMMARY OF THE INVENTION

The present invention provides spinning rings having a traveler bearing surface that can be used at high productivity spinning speeds without spalling or cracking of the bearing surface of the spinning ring. The spinning rings of the present invention can be used in the as-manufactured state for high speed spinning of fine yarns; that is, no break-in period is required in order to achieve high speed spinning of fine yarns. Nevertheless, the spinning rings of the present invention have a hard and durable traveler bearing surface such that the rings can be used for high speed spinning without substantial degradation of the frictional characteristics of the traveler bearing surface of the spinning rings for periods of greater than about one year, typically longer.

The spinning rings of the present invention comprise an electroplated, hard amorphous chromium coating having a thickness of between about 0.05 mil (0.00005 in.) and about 1.5 mil (0.0015 in.), preferably between about 0.2 mil (0.0002 in.) and about 0.4 (0.0004 in.). The chromium plating can be applied to spinning rings formed from conventional base metals such as carbon steels and steel alloys. The frictional characteristics of the traveler bearing surface of the spinning ring are such that the ring can be used for high speed spinning in the as-plated state without the necessity of a polishing or conditioning treatment.

In particular, spinning rings of the present invention are capable of immediate use in a high speed spinning operation in which a 50 cotton count yarn is spun at a spinning speed such that the traveler moves at a velocity of at least about 35 meters per second for a period of at least about 3 days without burn-off of the traveler or other degradation of the traveler sufficient to require traveler replacement.

Preferably, the amorphous chromium coating applied to the spinning ring surface has a hardness exceeding at least about 900 Vickers hardness ($HR_c67$), more preferably about 1,070 Vickers hardness ($HR_c70$) or greater. Despite the extremely hard and durable surface of the spinning ring, the ring can be used with conventional travelers at high speeds without break-in or conditioning of the spinning ring surface.

The amorphous, hard chromium coatings employed in the present invention can be smooth or nodular, preferably smooth. However, the coatings generally exhibit a bright satin white appearance having a brightness less than that of the bright, mirror-like surface of conventional bright chromium plating. As compared to the nodular, crystalline, hard chromium coatings employed in Applicant's assignee's commercially available high durability spinning rings, the chromium coatings employed in the present invention are generally brighter in the as-plated state, even in the case of a nodular amorphous chromium coating.

The improved durability of the chromium coatings employed in the present invention is believed to be due to the absence of shear planes within the matrix of the chromium coating. In particular, conventional electrodeposited hard chromium coatings are crystalline in nature with the result that stresses applied to the chromium coating are concentrated along the shear planes of the crystalline chromium coating matrix. The absence of a crystalline structure in the chromium coatings employed in the present invention greatly improves stress distribution because there is no stress concentration along shear planes so that fatigue cracking which is characteristic of conventional chromium coatings, is avoided in the spinning rings of the present invention.

The spinning rings of the present invention can be prepared using known commercially available technologies. Hard amorphous chromium plating technology is well known in the art and can be applied according to various processes including electroplating processes, incorporating an organic additive in a somewhat modified conventional hard chromium plating process.

Amorphous chromium coated spinning rings according to the present invention provide numerous benefits and advantages. The elimination of the necessity for a break-in, or conditioning period can substantially improve manufacturing efficiencies in the spinning operation. The time and costs associated with manufacture of the spinning rings of the present invention are substantially improved since polishing operations for improving surface finish prior to use of the spinning rings are not necessary.

DETAILED DESCRIPTION OF THE INVENTION

In the following detailed description, preferred embodiments of the invention are described to enable practice of the invention. Although specific terms are used to describe and illustrate the preferred embodiments, such terms are not intended as limitations on the practice of the invention. Moreover, although the invention is described with reference to preferred embodiments, numerous variations and modifications of the invention will be apparent to those of skill in the art upon consideration of the foregoing and following detailed description.

Figure 1:
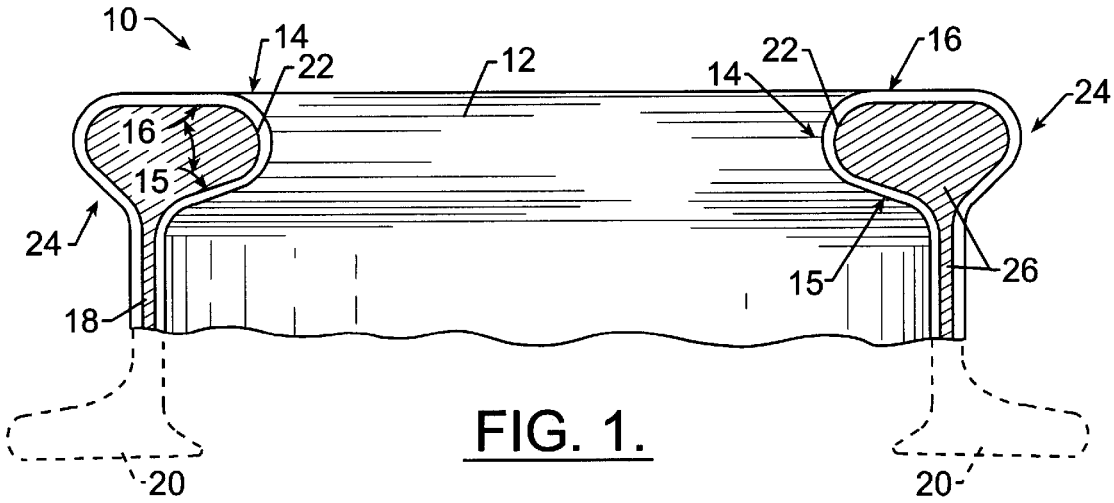
FIG. 1 is an enlarged fragmentary cross-sectional view illustrating the flange portion of a spinning ring that receives and guides a traveler and also illustrates the amorphous chromium plating thereon, in accordance with the present invention.

FIG. 1 illustrates an upper flange portion of a spinning ring 10 according to the present invention. The spinning ring 10 includes an annular flange 12 for supporting and guiding a traveler (not shown). The spinning ring includes a traveler bearing surface 14 located on the interior circumferential surface thereof located between the areas 15 and 16 shown in FIG. 1. The flange 12 of the spinning ring 10 is supported by a relatively narrow vertical or neck portion 18, which in turn connects the flange 12 to a lower mounting flange or similar adapter 20, shown in phantom in FIG. 1. The mounting flange or adapter 20 can have numerous and varying shapes and is used for mounting of the spinning ring 10 to the ring rail of a spinning apparatus as will be apparent to the skilled artisan. The shape and structure of the mounting adapter 20 will vary depending on the construction of the particular spinning equipment as is also known to the skilled artisan. In some cases, the ring 10 can be a reversible ring having a second flange (not shown) at the lower portion of the spinning ring when the spinning equipment is constructed to mount the spinning ring via a second flange. It will be further apparent to the skilled artisan that flange 12 can have any of various cross-sectional shapes for cooperating with a traveler positioned about the flange 12.

Returning now to FIG. 1, at least the traveler bearing surface 14 of the flange 12 comprises an electrodeposited amorphous chromium coating 22. Typically, the amorphous chromium coating 22 can also be present on other portions of the spinning ring such as exterior surfaces 24 of the flange and/or interior and exterior surfaces of the neck 18 of the spinning ring. The extent of the chromium coating can be controlled through the use of shaped anodes and masking treatments for the surfaces of the base as will be apparent. Normally the traveler bearing surface 14 comprises a hard amorphous electrodeposited chromium coating having a thickness at least about 0.05 mils, preferably greater than about 0.1 mils. It is typically advisable to limit the maximum amorphous electrodeposited chromium coating thickness to about 0.5 mils. Thickness in excess of about 0.5 mils tends to cause the surface of the coating to become nodular with stress concentrations being exhibited in the nodular areas.

The basis metal forming the base portion 26 of the spinning ring 10 is preferably formed of an alloy steel such as AISI 52100 hardened to a hardness of about $HR_c$ 60 (about 700 Vickers) but may also be formed of various other materials such as various ferrous alloys that preferably have a hardness of at least about $HR_c$ 50 (about 600 Vickers) or higher, preferably at least about $HR_c$ 60 (about 700 Vickers) or higher. The high hardness is preferred to support the thin dense chromium coating on the surface.

Figure 2:
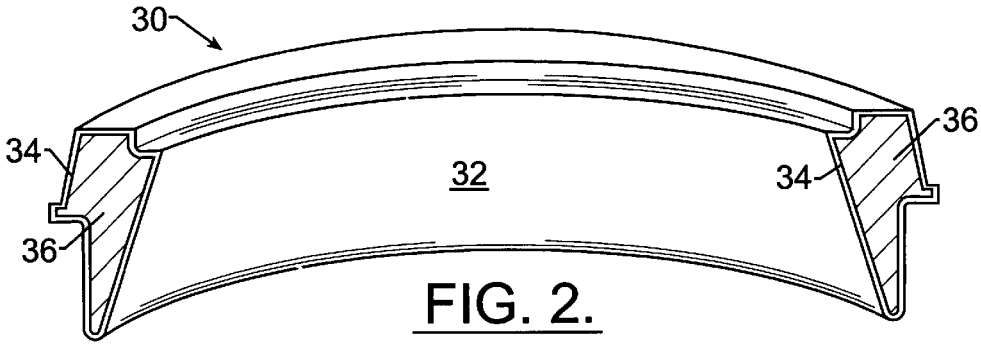
FIG. 2 is an enlarged fragmentary cross-sectional view illustrating an alternate vertical spinning ring and the amorphous chromium plating thereon, in accordance with the present invention.

The spinning ring to which the amorphous chromium plating is applied is not limited to the flange type embodiment shown in FIG. 1. In this regard, the spinning ring can likewise incorporate any of the various shapes and structures known in the art in connection with vertical and horizontal rings and with reversible and non-reversible rings. For example, shown in FIG. 2 is an alternate embodiment of a vertical spinning ring 30, in accordance with the present invention. The vertical spinning ring 30 includes a traveler bearing surface 32 located on the interior circumferential surface of the ring for supporting and guiding a traveler (not shown). At a minimum the traveler bearing surface 32 comprises an electrodeposited amorphous chromium coating 34. Typically, and as illustrated in FIG. 2, the amorphous chromium coating 34 can also be present on other portions of the spinning ring as the plating process dictates. The basis metal forming the base portion 36 of the spinning ring 30 is preferably formed of an alloy steel such as AISI 52100 steel or the like.

Figure 3:
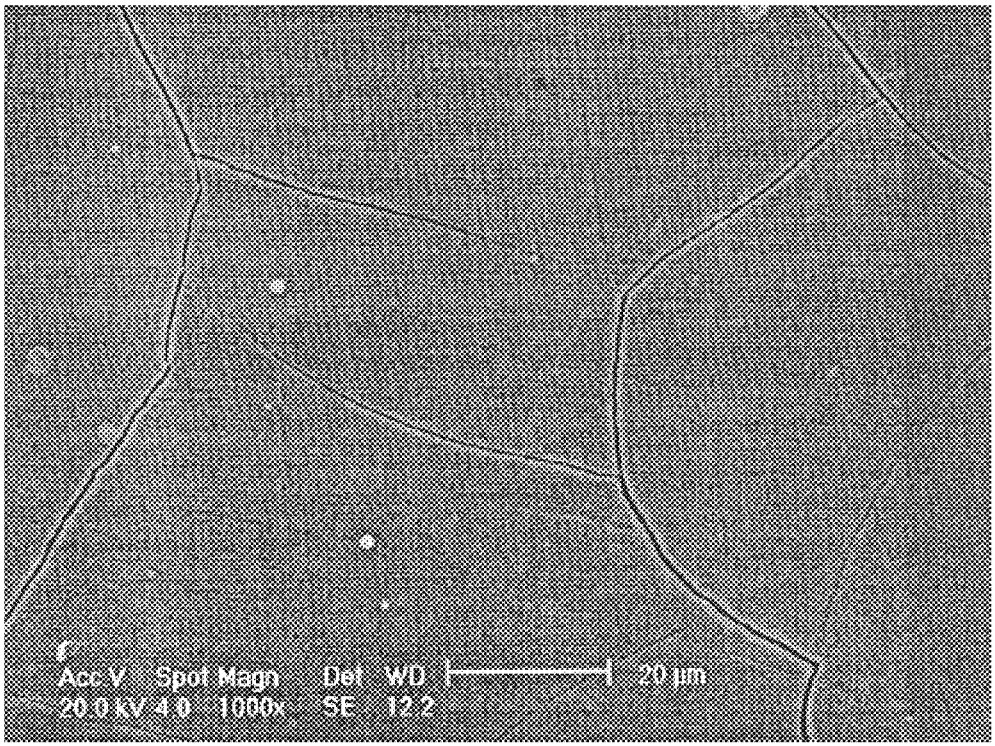
FIG. 3 is a high magnification scanning electron microscope (SEM) photograph of a conventional hard chromium plated spinning ring surface, in accordance with the prior art.
Figure 4:
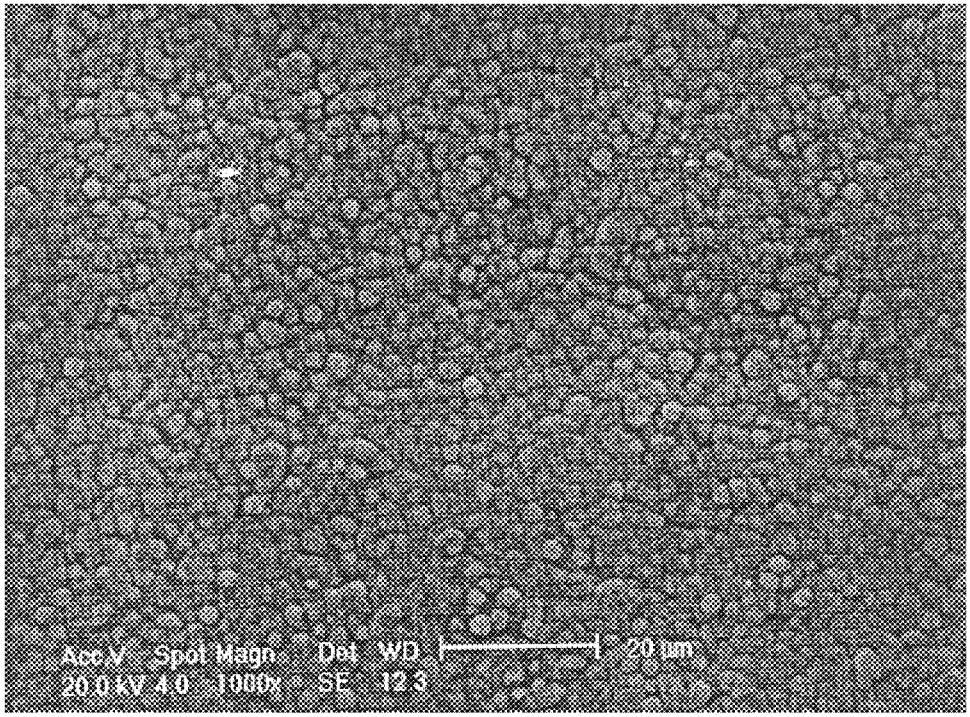
FIG. 4 is a high magnification SEM photograph of the chromium surface of a hard nodular chromium coated spinning ring, in accordance with the prior art.

Referring now to FIGS. 3 and 4, 1000× SEM photographs of crystalline chromium electroplated surfaces on commercially available spinning rings are illustrated.

The chromium plating illustrated in FIG. 4 is a conventional hard bright chromium plating in accordance with the prior art. As seen in FIG. 3, the surface includes a plurality of microcracks which are believed to be formed as a result of the high residual stresses generated in the chromium layer during the electrodeposition process. During the operational life of the spinning ring stress concentrations at the microcracks propagate along shear planes causing cracking, peeling and/or catastrophic failure of the spinning ring.

FIG. 4 illustrates a prior art nodular electrodeposited chromium coating on a spinning ring in accordance with previously incorporated by reference U.S. Pat. No. 5,829,240. The nodular nature of the surface topography decreases the stress concentrations that are typically observed in plating structures having a generally smooth finish and thus the frequency of microcracks is markedly diminished. However, the nodular chromium coating will typically require a break-in period in which the spinning ring will be limited to low-speed operation. Additionally, the nodular chromium coating will typically undergo a polishing operation prior to use to reduce the degree of grain separation and provide for a more uniform nodular surface.

Figure 5:
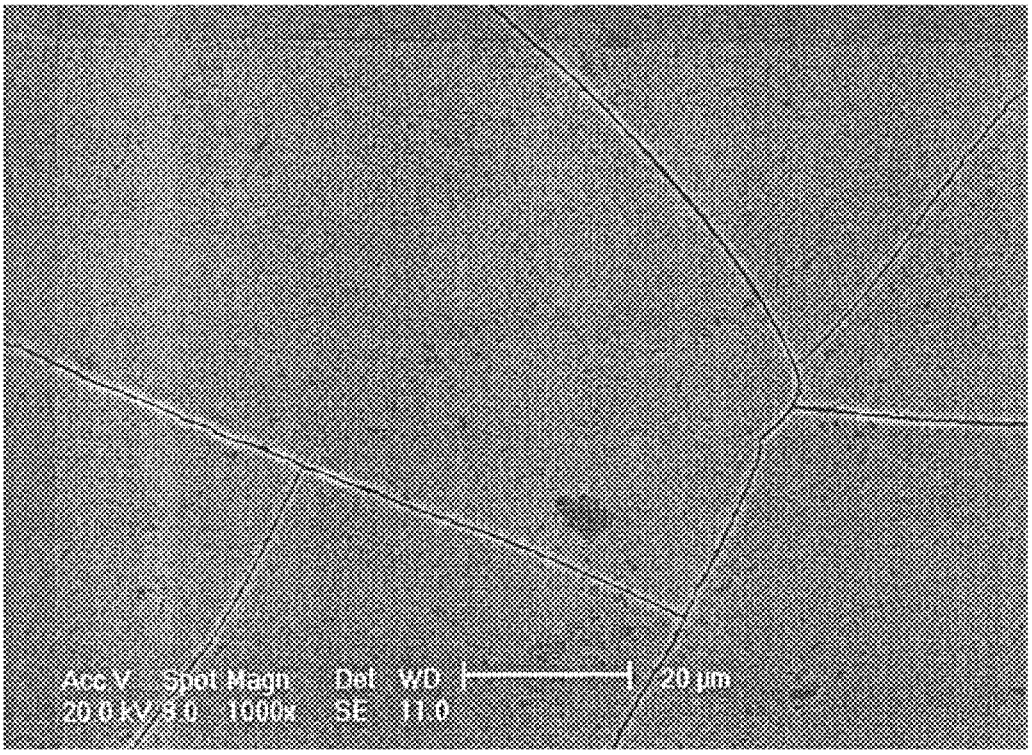
FIG. 5 is a high magnification SEM photograph of the surface of an amorphous chromium electroplated spinning ring, in accordance with the present invention.
Figure 6:
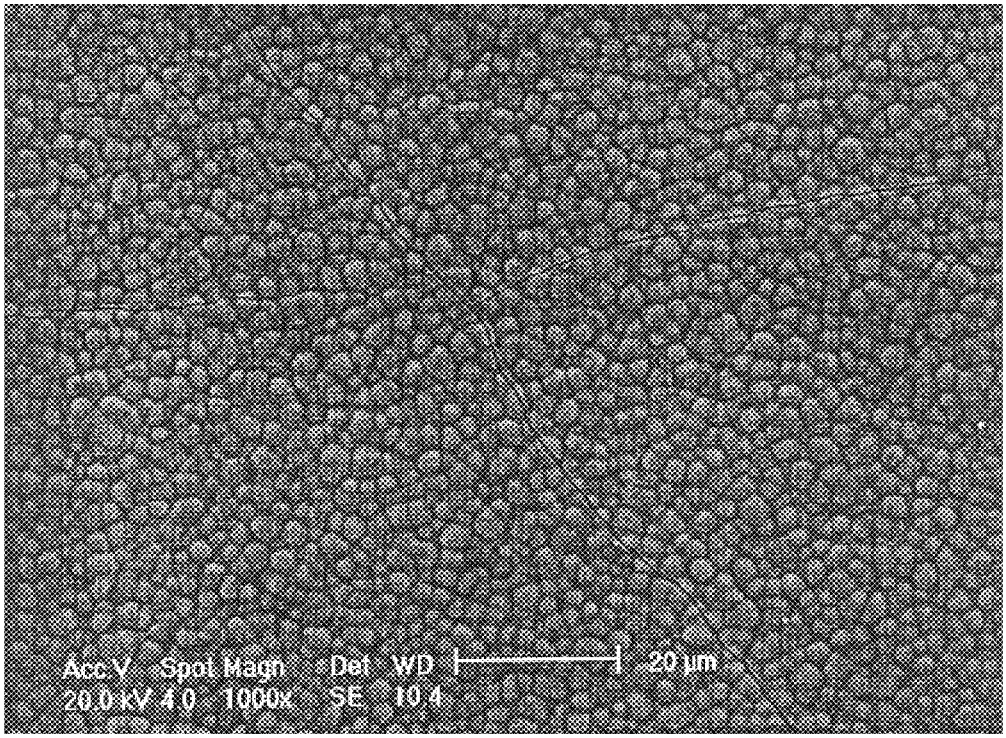
FIG. 6 is a high magnification SEM photograph of a nodular amorphous chromium coated spinning ring surface in accordance with the present invention.

FIGS. 5 and 6 illustrate 1000× SEM photos of amorphous chromium coated spinning rings, in accordance with preferred embodiments of the present invention. The chromium coating of FIG. 5 is generally similar to the coating surface observed in the non-amorphous coating shown in FIG. 3 (i.e. both FIG. 3 and FIG. 5 depict pronounced microcracks typically formed during application of the coating). However, the microcracks observed in the structure shown in FIG. 5 will not typically propagate over time because the amorphous structure of the chromium coating does not define shear planes. Additionally, a cross-section of the amorphous chromium coating shown in FIG. 5 will typically have a generally undulating surface as opposed to the generally flat surface of the non-amorphous chromium coating shown in FIG. 3.

The amorphous chromium coating illustrated in FIG. 6 is a highly nodular structure. The nodular structure typically results from exceeding the preferred coating thickness. It has been observed that as the coating thickness exceeds about 0.5 mils the surface takes on nodular characteristics. Similar to the amorphous structure shown in FIG. 5, the nodular embodiment exhibits microcracks typically formed during coating application. However, the microcracks observed in the structure shown in FIG. 6 will not typically propagate over time because the amorphous structure of the chromium coating does not define shear planes. Nevertheless, the nodular structure seen in FIG. 6, while still being a type of amorphous chromium plating embodied within the invention, is not the preferred form of the plating structure.

Figure 7:
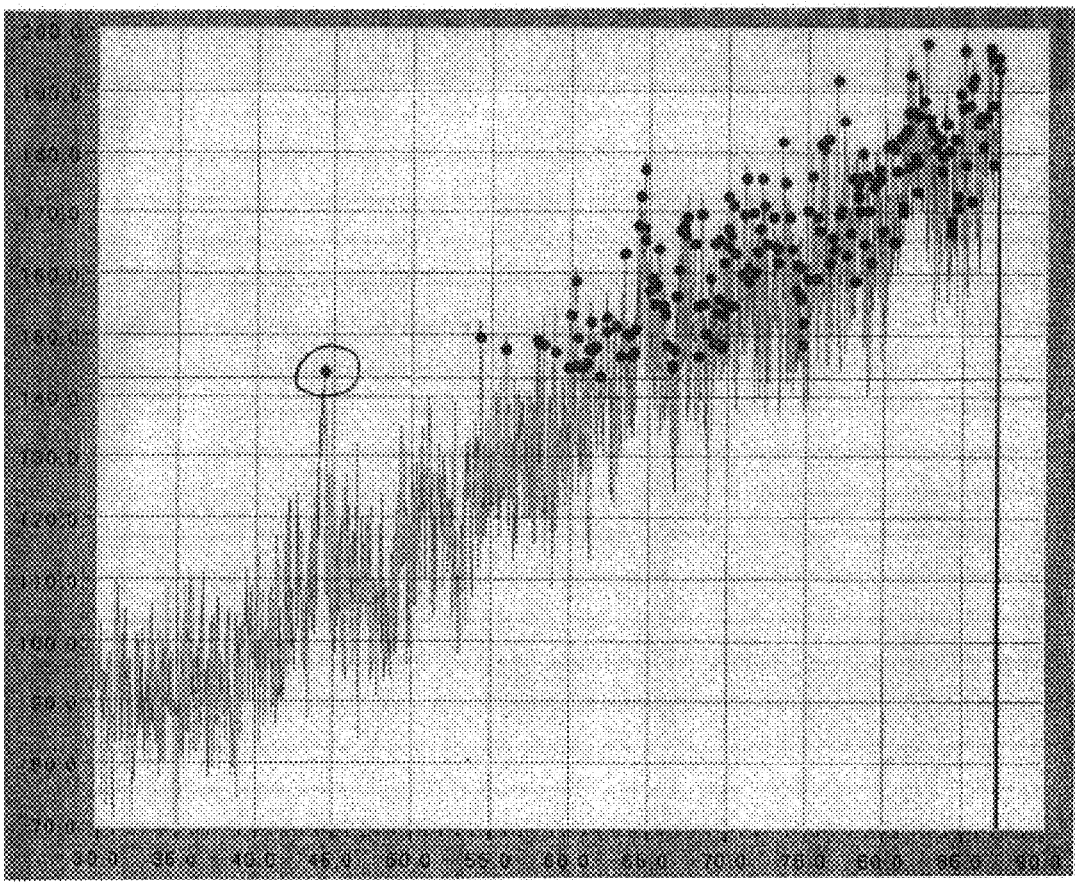
FIGS. 7, 8, 9 and 10 illustrate x-ray diffraction patterns taken from the chromium surfaces illustrated in FIGS. 3–6, respectively, and demonstrate the x-ray diffraction pattern differences between the crystalline and amorphous chromium structures.
Figure 8:
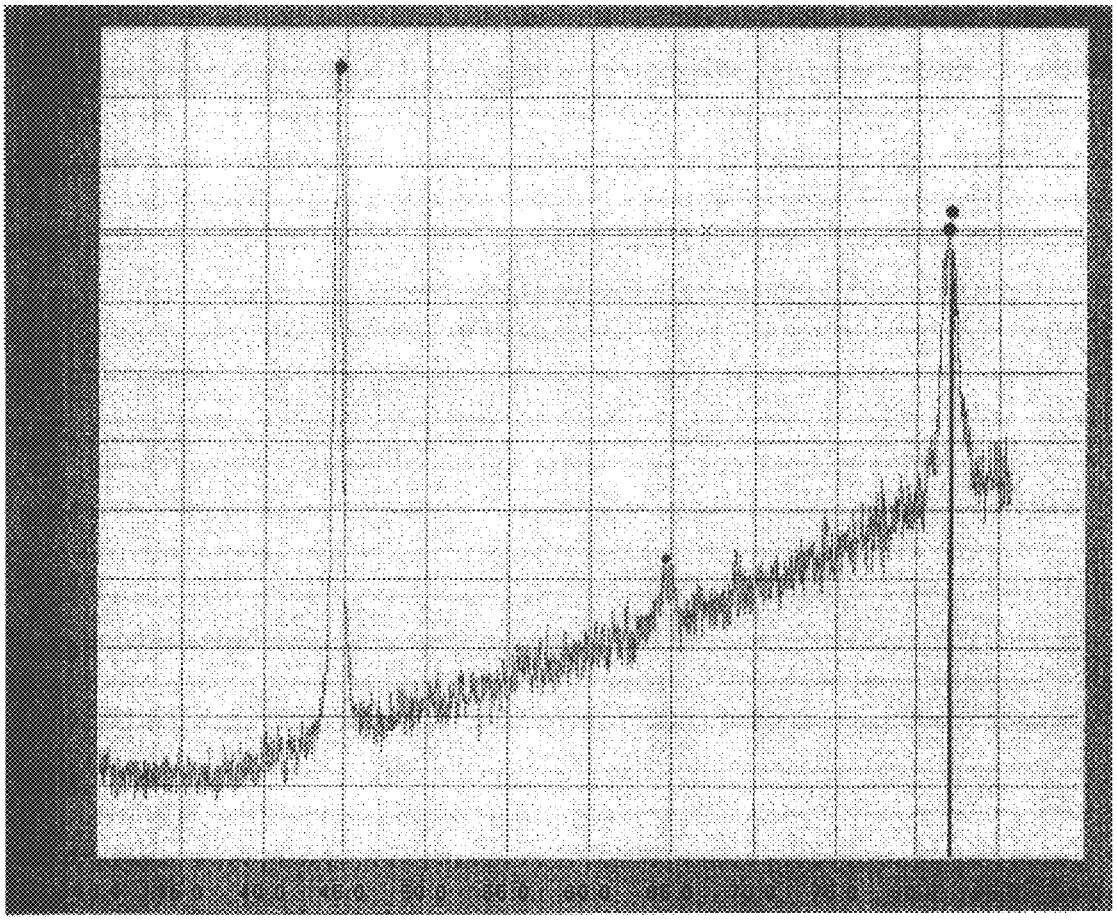

FIGS. 7 and 8 illustrate x-ray diffraction patterns taken of the crystalline chromium coatings shown in FIGS. 3 and 4, respectively. The x-ray diffraction patterns were made using a x-ray diffractometer having a copper target and operating on the power settings of 35 kilovolts (KV) and 20 milliamps (mA). As can be seen from FIGS. 7 and 8, the chromium coatings of FIGS. 3 and 4 each demonstrate strong x-ray diffraction peaks at 45, 65, and 82 degrees two-theta value. These peaks are characteristic of crystalline chromium structures. Specifically, the peak at 45 degrees is characteristic of the <110> plane; the peak at 65 degrees is characteristics of the <200> plane, while the peak at 82 degrees is characteristics of the <211> plane. For the purposes of the present invention, a chromium coating is considered amorphous by the absence of any peak corresponding to any of the <110>, <200> or <211> planes as determined by conventional x-ray diffraction techniques. Highly desirable amorphous chromium coatings are characterized by the absence of at least the peak corresponding to the <110> plane.

Figure 9:
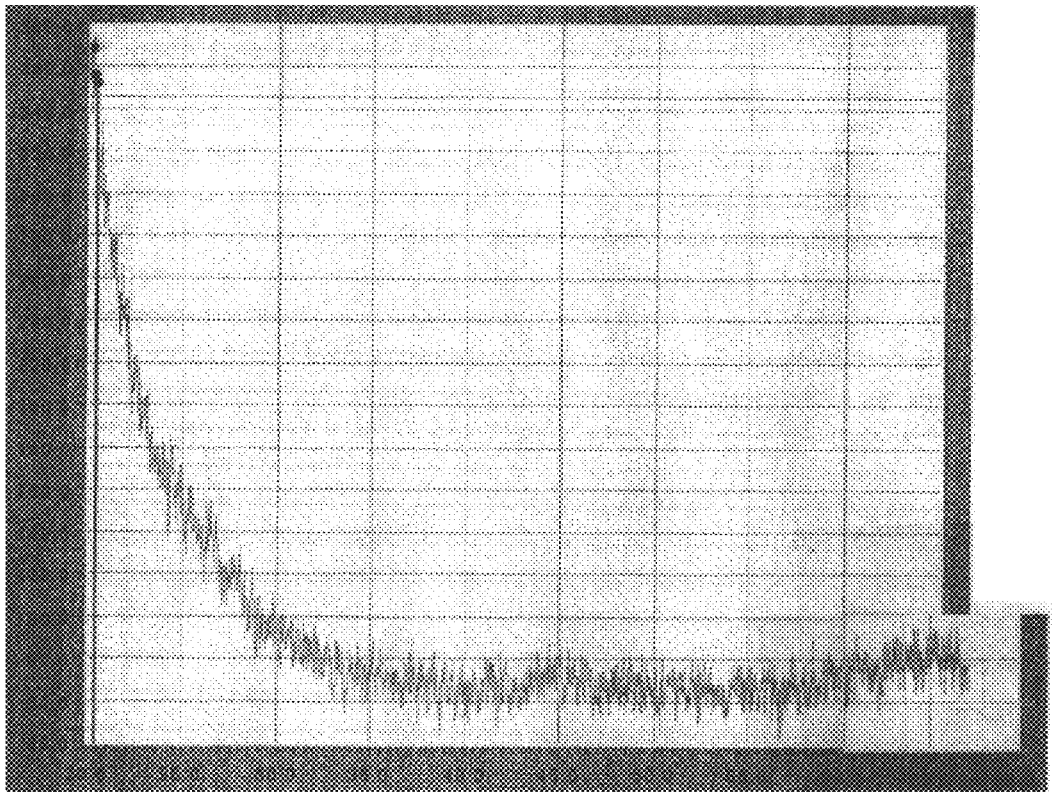
Figure 10:
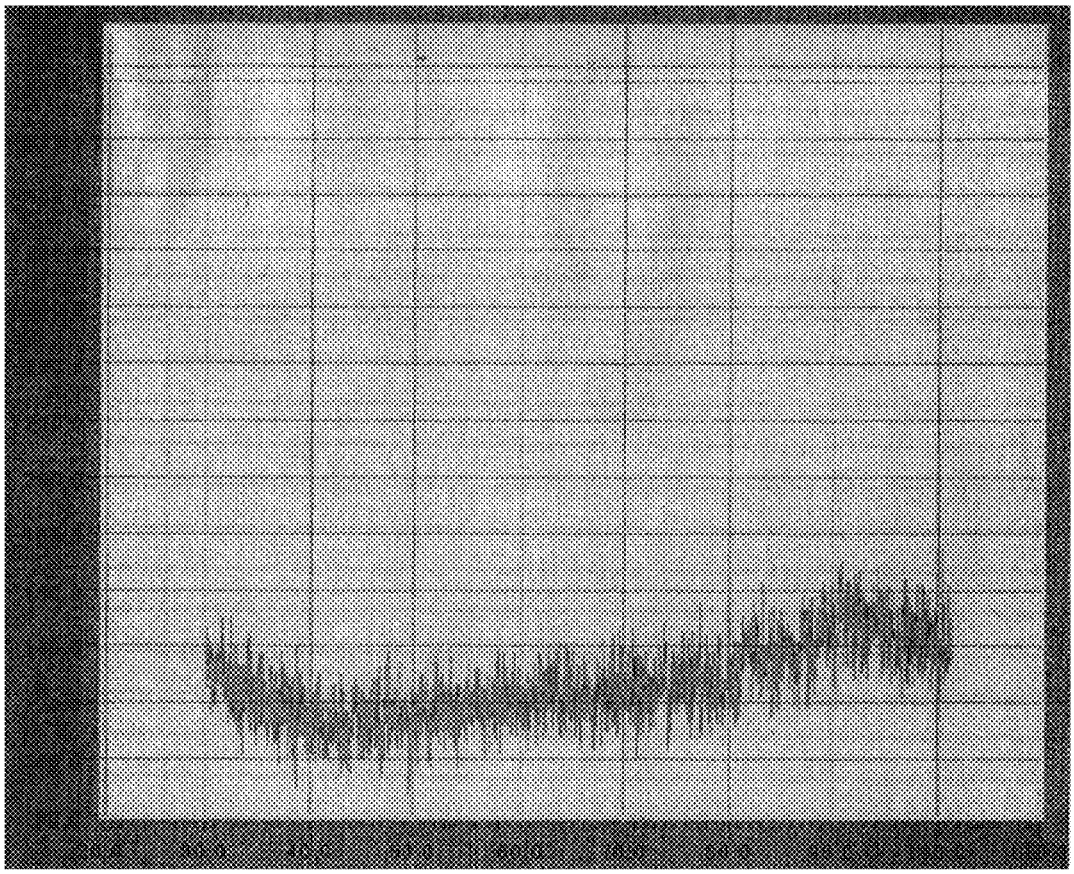

In contrast and in accordance with the present invention, FIGS. 9 and 10 illustrate x-ray diffraction patterns taken on the chromium electroplated coatings shown in FIGS. 5 and 6, respectively. As illustrated, no peak corresponding to any of the <110>, <200>, or <211> planes can be identified in these x-ray diffraction patterns. Accordingly, it will be apparent to those skilled in the art that the chromium coatings of FIGS. 5 and 6 are amorphous chromium coatings.

The amorphous chromium coatings illustrated in FIGS. 5 and 6 can be applied to the surface of a spinning ring using conventional electroplating techniques, typically followed by conventional stress release techniques. One process for electroplating of a hard amorphous chromium coating is discussed in detail in *Corrosion and Wear Properties of Electrodeposited Amorphous Chrome*, Choi, Yong, Journal of Materials Science, pp. 1581–1586, (1997) which is hereby incorporated by reference. As indicated previously, hard amorphous chromium electrodeposited coatings can also be obtained from commercial chromium plating businesses.

In general, the provision of an electrodeposited, hard amorphous chromium coating involves the steps of cleaning and/or surface activation, followed by electroplating, followed by a stress relief heat treatment. Any of various cleaning and surface activation processes as are well known to those skilled in the art can be used prior to electroplating. Exemplary cleaning and activation processes are described, for example, in "Hard Chromium Plating" by Hyman Chessin and Everett H Fernald, Jr., published in *Metals Handbook*, 9th Ed., Vol. 5, "Surface Cleaning, Finishing and Coating," pp. 170–187 which is hereby incorporated herein by reference. Thereafter, the amorphous chromium coating is applied by electrodeposition. As known to those skilled in the art, and described in the foregoing Choi article, amorphous chromium can be advantageously deposited by employing a chromium plating solution containing an organic reagent or a comparable additive such as an organic acid that promotes amorphous electrodeposition of a hard chromium layer.

In one embodiment of the present invention the amorphous chromium coating is deposited on the spinning ring by employing a standard electrodeposition technique. A typical plating bath will comprise about 8.0 to about 14.0 percent chromic acid, about 1.0 to about 3.0 percent organic acid and about 0.10 to about 0.50 percent oxyacid. In one embodiment the plating bath may comprise about 11.0 chromic acid, about 2.0 percent formic acid and about 0.25 sulfuric acid. The plating operation will typically be carried out at an amperage of about 0.6 $A/dm^2$. The duration of the electrodeposition process will vary in accordance with the desired plating thickness; in general the process will vary from about 8 minutes to about 15 minutes.

In general, electroplating conditions are varied to provide a hardness greater than about 900 Vickers ($HR_c67$), preferably greater than about 1,070 Vickers ($HR_c70$). As known to those skilled in the art, hardness of the chromium electroplated coating can be controlled by varying current densities and treatment time as discussed in, for example, the aforementioned Chessin et al. article and the aforementioned Choi article.

Following deposition of the amorphous chromium coating, the chromium coated spinning ring is recovered and heat treated to release stresses induced during the chromium coating. Stress relief treatments are well known to those skilled in the art. Preferably, the stress relief treatment is conducted at a temperature between about 250° F. and about 350° F.

Although both the crystalline chromium coatings of FIG. 3 and the amorphous chromium coatings of FIGS. 5 and 6 exhibit microcracking, the nature of the microcracking is believed substantially different. In the case of the conventional crystalline hard chromium coating of FIG. 3, the microcracks are formed along shear planes resulting from the regular crystalline structure of the chromium coating. These types of microcracks can be expected to propagate further as the chromium coating is exposed to repetitive fatigue stress from movement of a traveler around the surface of the ring. On the other hand, the microcracks as shown in FIGS. 5 and 6 are not formed along crystalline boundaries since there is no crystalline structure in the amorphous chromium coating. Accordingly, stress is not concentrated along shear planes as the ring surface is exposed to repetitive stress from movement of the traveler. Thus, further propagation of the microcracks is minimal, if at all, and degradation of the frictional surface properties of the amorphous chromium coating due to development of further fatigue cracking is minimized.

In actual experience, it has been found that amorphous chromium electroplated spinning rings prepared according to the present invention in which the amorphous chromium coating has a hardness of 1200 Vickers (71 Rockwell) and wherein the spinning rings were exposed to a heat stress relief treatment prior to use, the rings could be readily used to spin a 50 cotton count yarn at 20,000 rpm with no break-in period required. After a period of one year of substantially continuous operation at this speed, the frictional characteristic of the bearing surface of the spinning rings had not been degraded. For the purpose of the present invention, a spinning ring is considered to be useable without a break-in if the ring can be used to spin a 50 cotton count yarn at a speed of about 35 meters per second for three days without requiring a replacement of a suitably selected traveler in order to achieve and maintain a stable spinning operation. As will be known to those skilled in the art, the traveler speed is calculated by multiplying the length of the traveler bearing surface of the ring (ring diameter times Pi) by the speed, in revolutions per second, of the spinning operation.

The invention has been described in considerably detail with reference to its preferred embodiments. However, numerous variations and modifications can be made within the spirit and scope of the invention without departing from the invention as described in the foregoing detailed specification and defined in the appended claims.

That which is claimed:

1. A textile spinning ring comprising a base material that forms a bearing surface for receiving a traveler, said bearing surface comprising a coating of amorphous chromium, wherein the textile spinning ring is capable of being implemented in textile production without preliminary treatment of the bearing surface and without a production break-in period.

2. The textile spinning ring of claim 1, wherein said base material forms a flange comprising said bearing surface.

3. The textile spinning ring of claim 1, wherein said bearing surface is a circumferential bearing surface.

4. The textile spinning ring of claim 1, wherein said amorphous chromium coating is electrodeposited on said bearing surface.

5. The textile spinning ring of claim 1, wherein said amorphous chromium coating has a minimum thickness of about 0.05 mils and a maximum thickness of about 1.5 mils.

6. The textile spinning ring of claim 5, wherein said amorphous chromium coating has a thickness between about 0.2 mils and about 0.4 mils.

7. The textile spinning ring of claim 1, wherein said amorphous chromium coating has a hardness exceeding about 900 Vickers.

8. The textile spinning ring of claim 1, wherein said amorphous chromium coating is characterized by the absence of a x-ray diffraction peak corresponding to any one of the group consisting of the <110> plane, the <200> plane and the <211> plane.

9. The textile spinning ring of claim 1, wherein said amorphous chromium coating has a generally undulating, smooth surface topography.

10. The textile spinning ring of claim 1, wherein said amorphous chromium coating has a generally nodular surface topography.

11. The textile spinning ring of claim 1, wherein said ring can be operated to spin yarn without a break-in period.

12. The textile spinning ring of claim 1, wherein said base material comprises a ferrous alloy based metal.

13. The textile spinning ring of claim 12, wherein said base material further comprises steel.

14. The textile spinning ring of claim 12, wherein said ferrous alloy based metal has hardness of at least about 600 Vickers.

* * * * *

UNITED STATES PATENT AND TRADEMARK OFFICE

CERTIFICATE OF CORRECTION

PATENT NO. : 6,360,520 B2
DATED : March 26, 2002
INVENTOR(S) : Poquette et al.

It is certified that error appears in the above-identified patent and that said Letters Patent is hereby corrected as shown below:

Title page,
Item [60], Related U.S. Application Data, "Nov. 14, 2000" should read -- Jan. 14, 2000 --;
Item [56], References Cited, FOREIGN PATENT DOCUMENTS, "8/1989" should read -- 8/1891 --.

Column 1,
Lines 8 and 9, "Nov. 14, 2000" should read -- Jan. 14, 2000 --.

Signed and Sealed this

Third Day of September, 2002

*Attest:*

*Attesting Officer*

JAMES E. ROGAN
*Director of the United States Patent and Trademark Office*